United States Patent [19]

Watson et al.

[11] Patent Number: 4,804,601

[45] Date of Patent: Feb. 14, 1989

[54] ELECTROPHOTOGRAPHIC AND ELECTROGRAPHIC IMAGING PROCESSES

[75] Inventors: P. Keith Watson; Henry R. Till, both of Rochester, N.Y.; Melvin D. Croucher, Oakville, Canada

[73] Assignee: Xerox Corporation, Stamford, Conn.

[21] Appl. No.: 67,506

[22] Filed: Jun. 29, 1987

[51] Int. Cl.[4] ..... G03G 17/04

[52] U.S. Cl. ..... 430/32; 430/38

[58] Field of Search ..... 430/114, 115, 117, 119, 430/32, 38

[56] References Cited

U.S. PATENT DOCUMENTS

| | | | |
|---|---|---|---|
| 3,084,043 | 5/1959 | Gundlach | 96/1 |
| 3,806,354 | 4/1974 | Amidon et al. | 117/37 LE |
| 3,954,640 | 5/1976 | Lu et al. | 252/62.1 L |
| 4,024,292 | 5/1977 | Lu et al. | 427/17 |
| 4,197,211 | 4/1980 | Amidon et al. | 430/115 |
| 4,268,597 | 5/1981 | Klavan et al. | 430/102 |
| 4,454,833 | 6/1984 | McChesney et al. | 118/651 |
| 4,476,210 | 10/1984 | Croucher et al. | 430/114 |
| 4,533,611 | 8/1985 | Winkelmann et al. | 430/119 |

*Primary Examiner*—John L. Goodrow

*Attorney, Agent, or Firm*—E. O. Palazzo

[57] ABSTRACT

An imaging process which comprises the formation of an image on an imaging member; subsequently developing the aforementioned image with an electrophoretic liquid developer composition comprised of an insulating suspending fluid with a resistivity of from about $10^{12}$ ohm-cm to about $10^{16}$ ohm-cm, pigment particles, a stabilizer component, and a charge control additive; and wherein the resulting ink has a resistivity of from about $10^{9}$ to about $10^{12}$ ohm-cm; applying the ink composition from an applicator roll, which roll transports the ink to the imaging member surface; and wherein the ink is attracted to the charged areas of the imaging member.

25 Claims, No Drawings

ELECTROPHOTOGRAPHIC AND ELECTROGRAPHIC IMAGING PROCESSES

BACKGROUND OF THE INVENTION

This invention generally relates to electrophotographic and electrographic imaging processes, and more specifically, the present invention is directed to improved imaging processes wherein electrophoretic liquid developer compositions are applied from an applicator roll in a manner that enables only the charged areas of the image bearing member to be developed, thereby minimizing ink vehicle carryout. Therefore, in one embodiment of the present invention there is provided an electrostatic lithography process wherein electrostatic latent images are developed with electrophoretic liquid developer compositions comprised of a nonvolatile insulating fluid, charged pigment particles, and a stabilizer component; and wherein the aforementioned composition is applied to an imaging member by an applicator roll, such as a gravure roll whereby there is enabled ink wetting of only the charged areas of the imaging member.

Electrophotographic and electrographic imaging processes with liquid developers are generally known. There is described, for example, in U.S. Pat. No. 3,954,640 liquid developer compositions which dry at ambient temperatures by penetration into paper, and wherein there remains a continuous film having excellent rub resistance on the surface thereof, which inks contain, for example, pigment and/or dye, resinous particles dispersed in a liquid carrier, dispersing agent, and from about 25 to about 90 percent by weight of a nonvolatile high boiling organic liquid carrier and/or solvent. More specifically, the types of inks utilized in the process of the '640 patent are illustrated in column 3, beginning at line 50, and continuing on to column 4. As noted in column 4, beginning at line 30, examples of hydrocarbon oils or mineral oils which may be selected include Magie Oil 520 and 620 having boiling points of within the range of 270 to 296° C., and 293 to 362° C., respectively. A similar teaching is presented in U.S. Pat. No. 4,024,292.

Illustrated in U.S. Pat. No. 3,084,043, the disclosure of which is totally incorporated herein by reference, is a liquid development process wherein there is selected, for example, a gravure roller; and wherein water based inks or oil based inks can be selected, reference column 2, lines 7 through 25. Inks selected for the process of the '043 patent are illustrated in column 7, beginning at line 42, and include those containing a water or oil soluble dye dissolved in water or oil; and there may also be selected alcohol base inks with additives therein such as ethylene glycol, see column 7, beginning at line 50. One disadvantage associated with the aforementioned inks and the processes thereof reside in the formulation of images of decreased resolution and with substantial background deposits in some situations, which disadvantages are alleviated with the processes of the present invention wherein there is selected, for example, oil based ink compositions with the characteristics indicated.

Other patents with similar teachings and directed to liquid developers include U.S. Pat. Nos. 3,806,354; 4,268,597; 3,669,886 and 3,901,696.

Additionally, there is illustrated in U.S. Pat. No. 3,806,354 the disclosure of which is totally incorporated herein by reference, liquid inks comprised of one or more liquid vehicles, colorants such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as an alkylated polyvinyl pyrrolidone. Also, there are described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

Although the above described liquid inks and processes are suitable in most instances for their intended purposes, there remains a need for new processes, particularly wherein electrophoretic liquid developer compositions are selected. More specifically, there is a need for imaging processes wherein undesirable ink vehicle carryout is minimized or substantially eliminated. In addition, there is a need for imaging processes wherein an electrophoretic ink is applid from an applicator such as a gravure roller configured in a manner that the liquid is electrostatically attracted to only the charged areas of the image bearing surface. Moreover, there is a need for liquid development processes wherein the ink composition contains an insulating fluid, particularly a nonvolatile component, thus permitting absorption of these components into paper substrates and eliminating environmental hazards, particularly insulating fluid evaporation into the surrounding atmosphere. Furthermore, there is a need for electrostatic processes wherein electrophoretic inks whose dielectric relaxation time is less than the process time are obtainable. Additionally, there is a need for a liquid development process wherein the ink residue remaining on the photoreceptor surface subsequent to image transfer and cleaning will not cause degradation of subsequent images due to electrical conduction over the surface of the photoconductor. There is also a need for imaging processes with electrophoretic particles present in the ink, which particles have attached thereto long chain polymers to prevent flocculation of the ink particles, yet permit their adhesion to paper. Also, there remains a need for liquid development processes wherein electrophoretic inks are applied from gravure applicators, and wherein the inks are caused to move in synchronism with the electrostatic image present on a conductive imaging member thereby enabling high development speeds and also limiting contact of the ink composition with charged regions of the imaging member, thus substantially eliminating undesirable solvent carryout. In addition, there is a need for imaging processes with ink compositions of certain characteristics, which compositions can be easily cleaned from the photoreceptor surface, have extended shelf life, and which are free of environmental hazards. These and other needs are obtainable with the process of the present invention.

SUMMARY OF THE INVENTION

It is an object of the present invention to provide development processes with liquid developer compositions with the above noted advantages.

In another object of the present invention there are provided improved imaging processes wherein electrophoretic liquid developer compositions are selected.

It is an additional object of the present invention to provide electrophotographic and electrographic imaging processes wherein there is utilized a gravure applicator configured in a manner to permit movement of a liquid developer contained therein in synchronism with an electrostatic image thereby enabling high speed development.

Another object of the present invention resides in an imaging process with an electrophoretic ink whose dielectric relaxation time is less than the process time, and wherein the ink composition is electrostatically attracted to and contacts only the imaged areas present on the photoconductive imaging member.

Moreover, in yet another object of the present invention there are provided development processes with electrophoretic inks wherein the conductivity of the ink is derived from the electrophoretic motion of the particles therein and their countercharge. Thus, when the residual ink particles have been cleaned from the imaging member surface, the resistivity of the fluid remaining thereon will be increased thereby eliminating surface charge leakage.

Furthermore, in another object of the present invention there are provided development processes with electrophoretic inks containing insulating, nonvolatile fluids with, for example, vapor pressures less than 0.01 millimeter of mercury (hg), and more specifically 0.0002 to 0.02 (Hg) at room temperature thereby reducing undesirable odors from solvent carryout, and wherein drying of the inks is accomplished by absorption thereby eliminating the need for heating processes of these vehicles into substrates such as paper.

In still another object of the present invention there are provided development processes with ink compositions of viscosities of from about 4 to about 100 centipoise.

Additionally, in another object of the present invention there are provided liquid development processes with electrophoretic particles of 0.5 to 5 microns average diameter permitting, for example, developed images possessing superior transfer efficiencies exceeding 80 percent in many instances, and enabling any ink particles remaining on the photoreceptor surface to be readily removed by a blade cleaner.

In another object of the present invention there are provided development processes with liquid developer compositions containing cyan, magenta, and yellow pigments, or mixtures thereof.

Moreover, in another object of the present invention there are provided ink compositions with high transfer efficiencies exceeding 90 percent or greater, which inks, for example, have a particle size diameter of from about 1 to about 5 microns.

These and other objects of the present invention are accomplished by the provision of an imaging process with electrophoretic liquid developer compositions. More specifically, the present invention is directed to imaging processes which comprise the formation of an electrostatic latent image on an imaging member; subsequently developing this image with an electrophoretic liquid developer composition comprised of an insulating suspending fluid with a resistivity of from about $10^{12}$ to about $10^{16}$ ohm-cm, pigment particles, stabilizer components, and charge control additives; and wherein the resistivity of the ink is from about $10^9$ to $10^{12}$ ohm-cm, which resistivity is caused by the electrophoretic mobility of the particles and their countercharges; thereafter applying the ink composition from an applicator roll with a configuration that enables the ink composition to be brought into proximity with the charged areas of the imaging member, and thus attracted to said imagewise charged areas. Accordingly, the electrophoretic inks useful in the present invention in one embodiment are comprised of from about 80 percent by weight to about 98 percent by weight of an insulating nonvolatile fluid such as Magiesol 60; from about 0.5 percent by weight to about 4 percent by weight of black or colored pigment particles, and from about 1 percent by weight to about 8 percent by weight of stabilizers as illustrated hereinafter; and from about 0.1 to about 5 percent by weight of a charge control component.

Generally, thus the process of the present invention comprises an imaging process which comprises the formation of an image on an imaging member; subsequently developing the aforementioned image with an electrophoretic liquid developer composition comprised of an insulating suspending fluid with a resistivity of from about $10^{12}$ ohm-cm to about $10^{16}$ ohm-cm, pigment particles, a stabilizer component, and a charge control additive; and wherein the resulting ink has a resistivity of from about $10^9$ to about $10^{12}$ ohm-cm; applying the ink composition from an applicator roll, which roll transports the ink to the imaging member surface; and wherein the ink is attracted to the charged areas of the imaging member.

In another embodiment of the present invention there is provided an imaging process comprised of generating an image on a photoconductive imaging member, contacting the imaging member with a gravure roller containing therein an electrophoretic developer composition wherein the applicator roll, which is rotating in near synchronism with the image bearing member surface, dispenses the ink compositions illustrated herein comprised of from about 80 to about 95 percent of Magiesol 60, from about 0.5 to about 2 percent by weight of pigment particles treated with steric stabilizers/binders, and a charge control additive selected to permit the particles to have a charge/mass ratio of from about 10 to about 1,000 microcoulombs per gram; and wherein the bulk resistivity of the ink composition is greater than $10^9$ ohm-cm.

Illustrative examples of insulating fluids that may be selected for the ink compositions useful for the process of the present invention include Magiesol 60, and water white colorless oils available from Magie Oil Company. Other insulating fluids that can be selected include Witsol 50, Isopar V, Paraflex HT-10, Shellflex 210, Shellflex 270, Parabase, and the like, which dry by absorption. Magiesol 60 is the preferred insulating fluid oil for the inks of the present invention primarily because of its low vapor pressure; it is odorless, water white in color, and is rapidly absorbed into paper. With further respect to the vapor pressure of the insulating fluids, generally the fluids selected have a pressure of from about 0.02 to about 0.0002 (Hg).

Colorants or pigments present in an amount of from about 0.5 percent by weight to about 5 percent by weight, and preferably present in an amount of from about 0.6 percent by weight to about 2.0 percent by weight that can be selected for the ink developers of the present invention are carbon blacks especially Microlith CT which is believed to be a resinated carbon black, available from BASF, Printex 140 V, available from Degussa, and Raven 5250 available from Columbian Chemicals; red, green, blue, cyan, magenta, or yellow pigments, and mixtures thereof; and other similar pigments. Illustrative examples of magenta materials that may be selected as pigments include, for example, Hostaperm Pink E and Lithol Scarlett. Illustrative examples of yellow pigments that may be selected are Diarylide Yellow and Permanent Yellow FGL, which illustrative examples of cyan pigments include Sudan Blue and copper phthalocyanine.

Illustrative examples of stabilizers that may be selected for the developers useful in the process of the present invention include Kraton G1701, a poly(styrene-hydrogenated butadiene) block copolymer available from Shell Chemical Company, Vistanex a polyisobutylene polymer available from Exxon Chemical Corporation, Polypale Ester 10 available from Hercules Chemical Company, Ganex V-216 an alkylated poly(vinyl pyrrolidone) available from GAF Corporation, and the like, which are present in an amount of from about 1 percent to about 8 percent by weight Charge control additives, which serve to impart an electrostatic charge to the ink particles are usually present in an amount of from about .05 percent by weight to about 0.5 percent by weight, and include zirconium octoate for positive particles, or lecithin for negative particles. Other known charge control agents include iron naphthenate, basic barium petronate, cobalt octoate, and aluminum stearate. Other similar charge control additives can be selected providing, for example, that they are absorbed at the pigment ink vehicle interface.

Other ink compositions that may be selected for the process of the present invention are the nonaqueous dispersion inks illustrated, for example, in U.S. Pat. No. 4,476,210, the disclosure of which is totally incorporated herein by reference. One advantage of the aforementioned ink particles resides in their coalescence onto the paper enabling the formation of a film thus permitting excellent fusing characteristics. Upon absorption of the oil into the paper the particles readily coalesce to form a film that contours the paper surface thereby imparting cohesion within the image layer and adhesion to the paper. In order for this process to take place, the glass transition of the polymer colloid should be between −20 and 10° C. Examples of such core materials are poly(ethyl acrylate) and copolymers of ethyl acrylate and vinyl pyrrolidone.

Of importance with respect to the process of the present invention is the selection of an applicator roll such as a gravure roller or squeeze foam roll, which roll transports the developer in synchronism with the image bearing member, and also serves to restrict the region within which actual development occurs, that is the ink is permitted to contact only those areas of the image bearing or photconductive member with charges thereon. In addition, this applicator roll substantially reduces the amount of ink placed in contact with the image bearing surface, thus limiting the amount of solvent transferred to the copy surface.

Another important characteristic associated with the process of the present invention is the utilization of an electrophoretic ink whose dielectric relaxation time is less than the development process time. More specifically, with respect to the relaxation time, the maximum value thereof was determined from a realization that the ink is to acquire a surface charge by conduction in the applied field at a time less than the development process time. Thus, for example, when the contact zone between the gravure roller and the imaging member is about 0.25 inches, a typical process speed is about 5 inches per second utilizing a development time $t_1$ of 50 milliseconds; therefore, the ink shuld polarize, that is acquire a surface charge by conduction in the applied field in less than 25 milliseconds which translates into the dielectric relaxation time of the ink. It is known that the dielectric relaxation time of the ink is represented by the formula $t_1 = p_i e_i e_0$, wherein $p_i$ is the bulk resistivity of the ink, $e_i$ is its dielectric constant, and $e_0$ is the permitivity of free space. To limit the extent of charge leakage, the relaxation time of the ink over the surface $T_2$ must be greater than the time between exposure and development $t_2$. Assuming a typical character width w, an acceptable image spread b (about half the required resolution), photoconductor dielectic constant $e_p$, and thickness s, the effective dielectric relaxation time is $T_2 = p_1 e_1 e_0$ bw/2 as, wherein a is the residual ink film thickness.

With further respect to the present invention, the gravure applicator roll rotates in a manner that its surface moves in synchronization with the image bearing surface thereby, for example, eliminating shear forces in the development zone and enabling unusually high development speeds in excess of 5 inches per second to about 20 inches per second. Moreover, the gravure applicator has the effect of bringing the electrophoretic ink into close proximity with the image bearing surface, thus in view of the nature of the electrostatic forces involved, the charged particles in the ink are attracted to the charged areas of the image bearing surface. Accordingly, since only the areas with electrostatic charge are contacted with the liquid developer composition, the developed images generated by the process of the present invention possess substantially reduced solvent content; and moreover, since low volatile insulating fluids are selected for the inks, undesirable copy odors are generally reduced, and adsorption drying becomes a preferred alternative to thermal fusing in view of the energy considerations.

Examples of processes to which the present invention is applicable include xerographic processes, electrographic recording systems, electrostatic printing processes, and facsimile processes. In all the aforementioned processes, the inks mentioned herein are selectively attracted to the image areas from applicator rolls thus enabling developed images with substantially reduced liquid hydrocarbon carryout, and moreover the liquid carryout is nonvolatile; and accordingly, the resulting final developed copy does not possess any undesirable odors. In addition, the resulting image dries by absorption into the paper thereby avoiding or reducing the need for a heater or fuser.

In regard to the electrostatic development process, where only the image area of the photoreceptor is contacted with the liquid developer from the gravure roller, about 5 to 10 percent of the imaging member surface usually is wetted. This selectivity of development has a significant effect on the quantity of ink vehicle transferred to the uncharged areas of the image bearing surface, and thus limits undesirable solvent carryout for the output copy or final image. In addition, with the selection of certain high boiling hydrocarbon fluid vehicles the fluid transferred to the output page may be dried by absorption into the paper thus eliminating or reducing the need for a fuser or heater in the electrostatographic imaging apparatus, including electrostatographic printers.

With further respect to the present invention and the following Examples, the imaging tests were accomplished on a prototype test imaging apparatus, wherein the photoreceptor was comprised of a supporting substrate of aluminum, a photogenerating layer of trigonal selenium, 90 percent by weight, dispersed in a polyvinl carbazole resinous binder, 10 percent by weight, and a charge transport layer containing N,N'-diphenyl-N'N-bis-(3-methylphenyl) 1,1'-biphenyl-4,4'-diamine, 55 percent by weight dispersed in 45 percent by weight of a polycarbonate resin, reference U.S. Pat. No. 4,265,990, the disclosure of which is totally incorporated herein by reference. The gravure roll selected was comprised of stainless steel and contained 200 grooves per inch with the depth of the grooves being approximately 40 microns. Additionally, the latent images on the aforementioned photoreceptor were formulated as illustrated in U.S. Pat. No. 4,265,990; and more specifically by selecting either a light lens optical system to discharge the nonimage areas or a laser when the information was in digital form. In addition, the photoreceptor process speed was about 5 inches per second.

Transfer efficiencies were obtained by measuring the amount of ink developed on the photoreceptor, and more specifically by imaging on the photoreceptor and subsequently wiping the ink therefrom with a sponge of a known weight. The increase in weight of the sponge was then measured, and thereafter the photoreceptor was imaged. This second image was then transferred to paper and the ink remaining on the photoreceptor after transfer to paper was measured using a sponge of a known weight. The percent transfer efficiency was then defined as the weight of ink transferred to paper by the weight of ink imaged on the photoreceptor after transfer divided by the weight of ink imaged on the photoreceptor. Optical densities of the images were obtained using a MacBeth densitometer.

In all instances, when using the ink compositions of the present invention the images obtained were of excellent resolution, that is no background deposits occurred.

The following examples are being supplied to further define specific embodiments of the present invention, it being noted that these examples are intended to illustrate and not limit the scope of the present invention. Parts and percentages are by weight unless otherwise indicated.

EXAMPLE I

A negatively charged ink composition containing 95.7 percent Magiesol 60, 2.0 percent Raven 5720®, 2.0 percent of Kalene 800, and 0.3 percent lecithin was prepared by placing the ink components in a Union Process 01 attritor together with ¼ inch stainless steel balls, and attriting the material at room temperature for 2 hours. An ink with a viscosity of 10 centipoise was obtained. The diameter size of the resulting ink particles was 0.8 micron and the electrophoretic resistivity due to the particles was $5 \times 10^{10}$ ohm-cm, yielding a relaxation time of 10 milliseconds, which is substantially less than the process time which is approximately 25 milliseconds. Upon imaging, black images were obtained on 4024® paper with an optical density of 1.2, and a resolution of 6 line pairs per millimeter. Also, the transfer efficiency of the ink from the photoreceptor to the paper was about 78 percent, and the image dried within 30 seconds by absorption of the Magiesol oil into the paper.

EXAMPLE II

A negatively charged ink composition containing 95.6 Magiesol 60, 2.2 percent Lithol Scarlett, and 2.2 percent OLOA 1200 (the OLOA 1200 functions as a charge control additive and a steric stabilizer) was prepared by repeating the procedure of Example I. An ink with a viscosity of 9 centipoise, a diameter of 1.1 microns, and an electrophoretic resistivity of $4 \times 10^{10}$ ohm-cm resulted. Upon imaging, magenta images were obtained on 4024® paper. The optical density of the images as measured using a Macbeth densitometer was 1.0, and the image resolution was 6 line pairs per millimeter. Also, the transfer efficiency of the ink from the photoreceptor to paper was 74 percent, and the image dried within 30 seconds of exiting from the imaging apparatus by absorption of the Magiesol oil into the paper.

EXAMPLE III

A negatively charged ink composition containing 95.9 Magiesol 60, 2.2 percent of Sudan Blue OS, 1.5 percent of Vistanex, and 0.4 percent basic barium petronate was prepared by repeating the procedure of Example I. An ink with a viscosity of 13 centipoise, a diameter of 1.0 micron, and electrophoretic resistivity of $1 \times 10^{10}$ ohm-cm resulted. Upon imaging, a cyan image was obtained. On 4024® paper the optical density of the images was 1.1, while the image resolution was 4 to 6 line pairs per millimeter. Also, the transfer efficiency of the ink was 81 percent and the image dried within 35 seconds after exiting from the imaging apparatus.

EXAMPLE IV

A negatively charged ink composition containing 95.1 percent Magiesol 60, 2.3 percent Permanent Yellow FGL, 2.3 percent Kalene 800, and 0.3 percent lecithin was prepared by repeating the procedure of Example I. An ink with a viscosity of 10 centipoise, a diameter of 1.1 microns, and an electrophoretic resistivity of $2 \times 10^{10}$ ohm-cm resulted. Upon imaging onto 4024® paper, a yellow image was obtained with an optical density of 0.8. The image resolution was found to be in excess of 5 line pairs per millimeter and the transfer efficiency was determined to be 73 percent. Also, the image was dried wtihin 20 seconds after exiting from the imaging apparatus.

Other modifications of the present invention will occur to those skilled in the art subsequent to a review of the present application. These modification, and equivalents thereof are intended to be included within the scope of this invention.

What is claimed is:

1. An imaging process which comprises the formation of an image on an imaging member; subsquently developing the aforementioned image with an electrophoretic liquid developer composition comprised of an insulating suspending fluid with a resistivity of from about $10^{12}$ ohm-cm to about $10^{16}$ ohm-cm, pigment particles, a stabilizer component, and a charge control additive; and wherein the resulting ink has a resistivity of from about $10^9$ to about $10^{12}$ ohm-cm; applying the ink composition from an applicator roll, which roll transports the ink to the imaging member surface; and wherein the ink is selectively attracted to the charged areas of the imaging member.

2. A process in accordance with claim 1 wherein the electrophoretic ink has a dielectric relaxation time less than the development process time.

3. A process in accordance with claim 1 wherein the electrophoretic suspending fluid, in the absence of pigment particles, has a dielectric relaxation time greater than the exposure-to-development time.

4. A process in accordance with claim 1 wherein the applicator is a gravure roll.

5. A process in accordance with claim 1 wherein the applicator rotates in synchronism with the surface of the imaging member.

6. A process in accordance with claim 1 wherein the insulating fluid is a nonvolatile fluid which dries by absorption into the paper thereby minimizing fluid odor.

7. A process in accordance with claim 1 wherein the insulating fluid is comprised of Magiesol 60.

8. A process in accordance with claim 1 wherein the insulating fluid has a vapor pressure of from about 0.0002 to about 0.02 millimeters of mercury.

9. A process in accordance with claim 1 wherein the pigment particles are carbon black.

10. A process in accordance with claim 1 wherein the pigment particles are cyan, magenta, yellow, or mixtures thereof.

11. A process in accordance with claim 1 wherein the stabilizer is a poly(styrene hydrogenated butadiene) block copolymer.

12. A process in accordance with claim 1 wherein the stabilizer is poly(isobutylene-co-isoprene) copolymer.

13. A process in accordance with claim 1 wherein the stabilizer is polyisobutylene.

14. A process in accordance with claim 1 wherein the insulating vehicle has a vapor pressure of not more than 0.1 millimeter mercury at 25° C.

15. A process in accordance with claim 1 wherein the charge control agents are present in an amount of from about 0.5 to about 5 percent by weight.

16. A process in accordance with claim 1 wherein the charge control additive is selected from the group consisting of zirconium octoate, iron naphthenate, lecithin, and polyisobutylene succinimide.

17. A process in accordance with claim 1 wherein the imaging member is a photoconductive material.

18. A process in accordance with claim 1 wherein there is selected an insulating imaging member.

19. A process in accordance with claim 1 wherein an electrostatic latent image is formed on the imaging member.

20. A process in accordance with claim 1 wherein the resistivity of the ink composition is from about $10^{10}$ to about $10^{11}$ ohm-cm.

21. A process in accordance with claim 1 wherein the electrophoretic suspending fluid has a dielectric relaxation time greater than the exposure-to-development time after removal of the pigment particles, and subsequent to transfer of the ink and the cleaning thereof.

22. A process in accordance with claim 1 wherein the insulating suspending fluid is present in an amount of from about 80 percent by weight to about 98 percent by weight.

23. A process in accordance with claim 1 wherein the pigment particles are present in an amount of from about 0.5 percent by weight to about 5 percent by weight.

24. A process in accordance with claim 1 wherein the stabilizer is present in an amount of from about 1 percent by weight to about 8 percent by weight.

25. A process in accordance with claim 1 wherein the transfer efficiency of the ink from the imaging member to the developed image exceeds about 75 percent.

* * * * *